US008727713B2

(12) United States Patent
Ono et al.

(10) Patent No.: US 8,727,713 B2
(45) Date of Patent: May 20, 2014

(54) ROTOR OSCILLATION PREVENTING STRUCTURE AND STEAM TURBINE USING THE SAME

(75) Inventors: Hideki Ono, Mito (JP); Takeshi Kudo, Hitachinaka (JP); Kenichi Murata, Hitachi (JP); Masataka Sonobe, Hitachi (JP); Tsutomu Sugiyama, Hitachiohmiya (JP)

(73) Assignee: Hitachi, Ltd., Tokyo (JP)

( * ) Notice: Subject to any disclaimer, the term of this patent is extended or adjusted under 35 U.S.C. 154(b) by 635 days.

(21) Appl. No.: 13/027,291

(22) Filed: Feb. 15, 2011

(65) Prior Publication Data

US 2011/0236189 A1 Sep. 29, 2011

(30) Foreign Application Priority Data

Mar. 26, 2010 (JP) ..... 2010-071263

(51) Int. Cl.
*F01D 11/02* (2006.01)

(52) U.S. Cl.
USPC ..... 415/173.6

(58) Field of Classification Search
USPC ..... 415/173.6, 174.5
See application file for complete search history.

(56) References Cited

U.S. PATENT DOCUMENTS

| | | | | |
|---|---|---|---|---|
| 4,370,094 | A * | 1/1983 | Ambrosch et al. | 415/173.6 |
| 4,420,161 | A | 12/1983 | Miller | |
| 6,068,443 | A * | 5/2000 | Aoki et al. | 415/173.5 |

FOREIGN PATENT DOCUMENTS

| | | | |
|---|---|---|---|
| GB | 1 505 534 | A | 3/1978 |
| JP | 56-69403 | A | 6/1981 |
| JP | 58-222902 | A | 12/1983 |
| JP | 59-49401 | | 3/1984 |
| JP | 63-205404 | A | 8/1988 |
| JP | 2-80702 | U | 6/1990 |
| JP | 9-264101 | A | 10/1997 |
| JP | 2002-227606 | A | 8/2002 |
| JP | 2005-105984 | A | 4/2005 |
| JP | 2006-104952 | A | 4/2006 |
| JP | 2006-105087 | A | 4/2006 |
| JP | 2007-120476 | A | 5/2007 |
| JP | 2008-184974 | A | 8/2008 |
| JP | 2010-7611 | A | 1/2010 |

OTHER PUBLICATIONS

H. Benckert, et al., Flow Induced Spring Coefficients of Labyrinth Seals for Application in Rotor Dynamics, NASA, 1980, pp. 189-212.

* cited by examiner

*Primary Examiner* — Nathaniel Wiehe
*Assistant Examiner* — Woody A Lee, Jr.
(74) *Attorney, Agent, or Firm* — Crowell & Moring LLP

(57) ABSTRACT

A rotor oscillation preventing structure for a steam turbine includes: a stator vane 3; a moving blade 1; a shroud cover 2 installed on an outer circumferential side distal end of the moving blade 1; and a plurality of seal fins 6 installed, at any interval in the axial direction of a rotor, on an wall surface of a stationary body located on an outer circumferential side of the shroud cover 2, a whirl preventing structure comprised of whirl preventing plates 9 or whirl preventing grooves 11 is provided at a shroud cover inlet return portion 10 of the shroud cover 2 so as to block the whirl flow of leakage flow 8 on an upstream side in an operating steam flow direction of the seal fins to reduce an absolute velocity component of the leakage flow 8 in a rotational direction of the rotor.

10 Claims, 8 Drawing Sheets

AXIAL VIEW

RADIAL VIEW

PRIOR ART

PRIOR ART

ROTOR OSCILLATION PREVENTING STRUCTURE AND STEAM TURBINE USING THE SAME

BACKGROUND OF THE INVENTION

1. Field of the Invention

The present invention relates to a rotor oscillation preventing structure for a steam turbine.

2. Description of the Related Art

Steam turbines generally have a plurality of stages composed of moving blades and stator vanes in the axial direction of a turbine rotor as shown in FIG. 7. A gap exists between a moving blade and an outer circumferential side stationary wall and a portion of operating steam leaks through this gap. Leakage flow does not allow the moving flow to generate power; therefore, it results in a loss. In order to minimize the leakage, labyrinth seal fins are installed vertically to the axis of the turbine at the outer circumferential side stationary wall facing a shroud cover on the outer circumference of the moving blades. The labyrinth seal fins, along with the outer circumferential side stationary wall, form labyrinth seals.

Incidentally, it is known that if the turbine rotor becomes eccentric with respect to the outer circumferential side stationary wall, fluid force acts in an eccentric-vertical direction, which causes self-induced oscillation called steam whirl.

In the shroud cover and labyrinth seals installed on the outer circumferential side stationary wall facing the shroud cover in the steam turbine, the turbine rotor may become eccentric with respect to the outer circumferential side stationary wall. In such a case, fluid force acts on the rotor in an eccentric-vertical, rotational direction, and then the rotor is displaced to the eccentric-vertical rotational direction. In the position after the displacement, the fluid force acts again in the eccentric-vertical, rotational direction to repeat the displacement. In this way, the rotor whirls. This self-induced oscillation is steam whirl.

Steam whirl has been studied through the ages. It is found that a whirl component of leakage flow passing through labyrinth seals contributes to instability (see H. Benckert: "Flow induced spring coefficients of labyrinth seals for application in rotor dynamics": NASA CP-2133: 1980).

Therefore, if the occurrence of steam whirl was predicted, measures for reducing whirl flow were adopted. However, to predict the occurrence of the steam whirl, the fluid force exerted on the rotor due to an eccentricity of several hundred μm has to be captured accurately. This is very difficult even if the most recent fluid analysis technologies are made full use of. Thus, as regards the steam whirl, it is preferable that the causes of the instability be excluded to the extent possible in a permissible range of cost with a safety factor ensured.

One of the conventional rotor oscillation preventing structures is a structure in which a whirl preventing plate is installed on an outer circumferential side stationary wall surface upstream of labyrinth seals in order to reduce the whirl component of leakage flow (see JP-2008-184974-A and JP-56-69403-A).

SUMMARY OF THE INVENTION

However, the rotor oscillation preventing structure as the above-mentioned conventional art may not satisfactorily exhibit its own function in some cases depending on the trajectory of the leakage flow.

For example, if a difference in thermal expansion between the rotor and the outer circumferential side stationary wall is large, a distance between the shroud cover and the vertical surface of the outer circumferential side stationary wall may have to be increased. In such a case, the whirl flow will not reach the whirl preventing plate installed on the vertical surface of the outer circumferential side stationary wall, and thereby the whirl preventing plate cannot satisfactorily exhibit its own function.

For this reason, a rotor oscillation preventing structure that functions irrespective of the positional relationship between the shroud cover and the outer circumferential side stationary wall is required.

Accordingly, it is an object of the invention to provide a rotor oscillation preventing structure for a steam turbine that can reduce whirl velocity of leakage flow flowing into labyrinth seals to reduce the occurrence potential of steam whirl irrespective of the positional relationship between a shroud cover and an outer circumferential side stationary wall.

According to an aspect of the present invention, there is provided a rotor oscillation preventing structure for a steam turbine which is formed with a whirl preventing structure formed at a shroud cover inlet return portion of a turbine moving blade to block whirl flow of leakage flow on an upstream side in an operating steam flow direction of seal fins, and thereby reducing an absolute velocity component of the leakage flow in the rotor rotational direction.

In the present invention, the whirl preventing structure is provided at the moving blade inlet return portion of the shroud cover which is a portion through which the leakage flow surely passes. Therefore, it is possible to reduce the whirl velocity of the leakage flow entering labyrinth seals to reduce the occurrence potential of steam whirl regardless of the positional relationship between the shroud cover and the outer circumferential side stationary wall.

DESCRIPTION OF THE PREFERRED EMBODIMENTS

Figure 1:
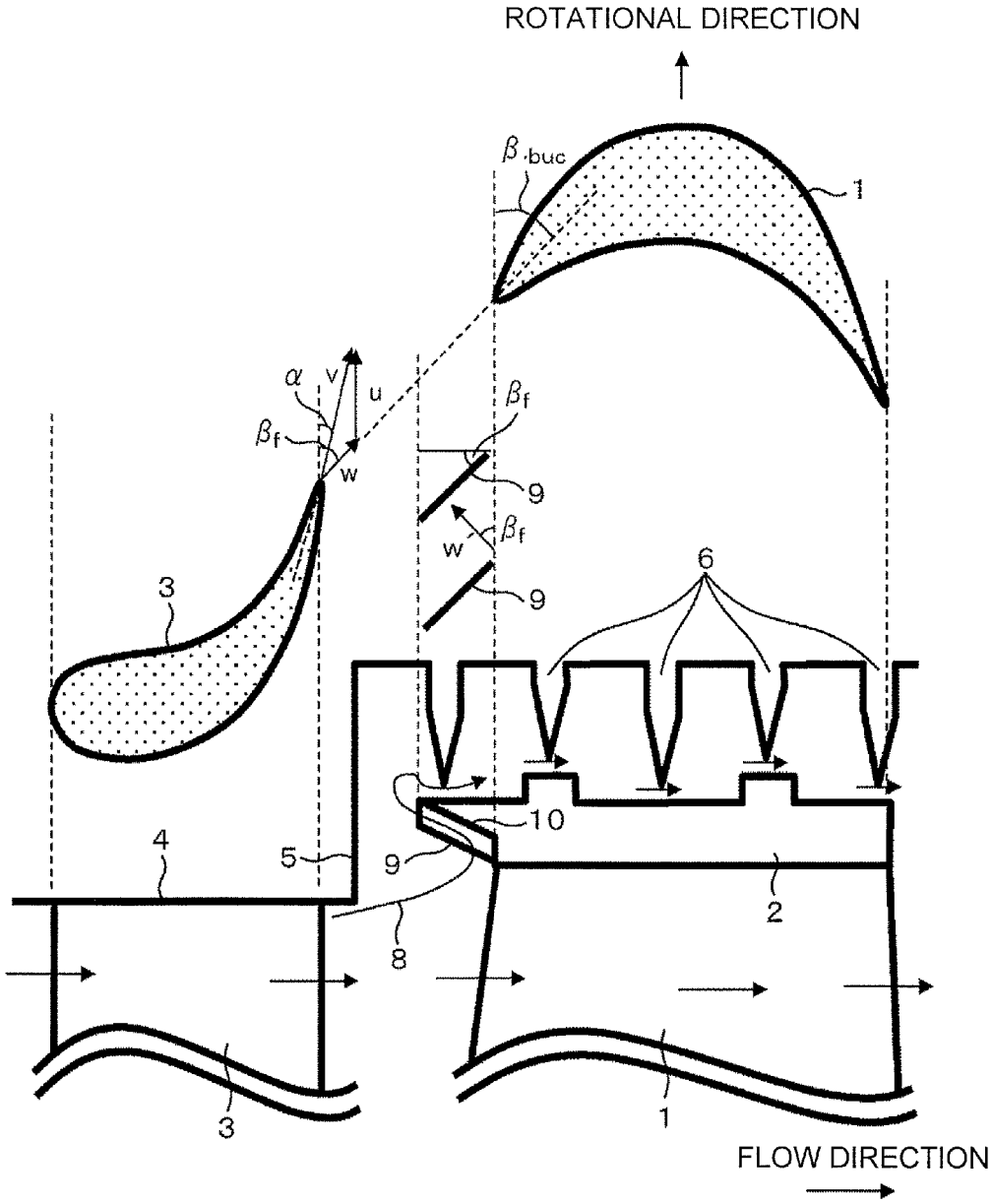
FIG. 1 is an explanatory view illustrating a structure of a turbine stage according to a first embodiment of the present invention as viewed from the radial direction (an upper view) and from the side (a lower view).
Figure 2:
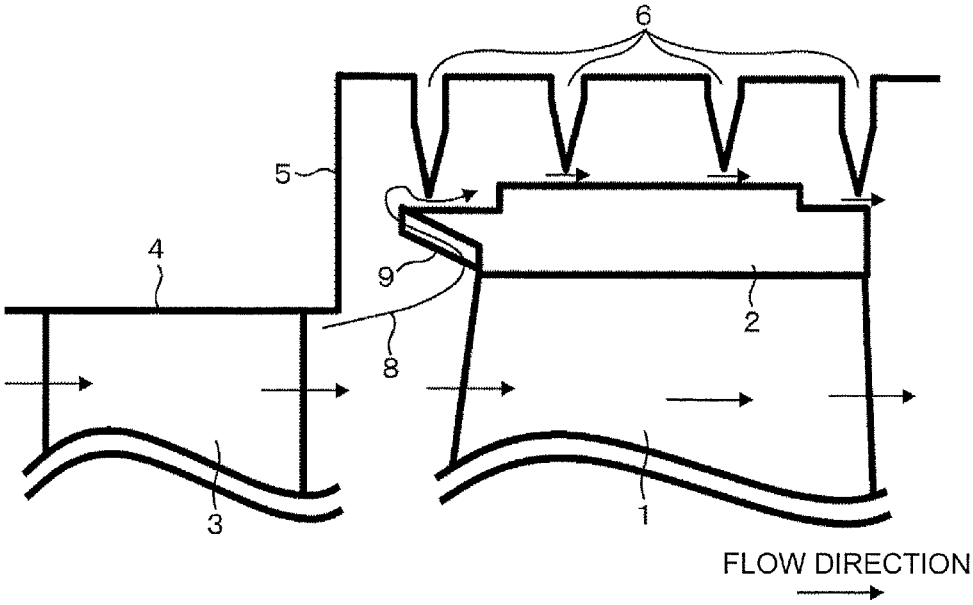
FIG. 2 is a cross-sectional view of the turbine stage according to the first embodiment of the present invention.

Preferred embodiments of the present invention will hereinafter be described in detail with reference to the corresponding drawings. It is to be noted that the same reference numerals are attached to similar or corresponding constituent elements over the drawings.

In order to facilitate the understanding of the present invention, the conventional technology and its problem are first described with reference to the drawings.

Figure 7:
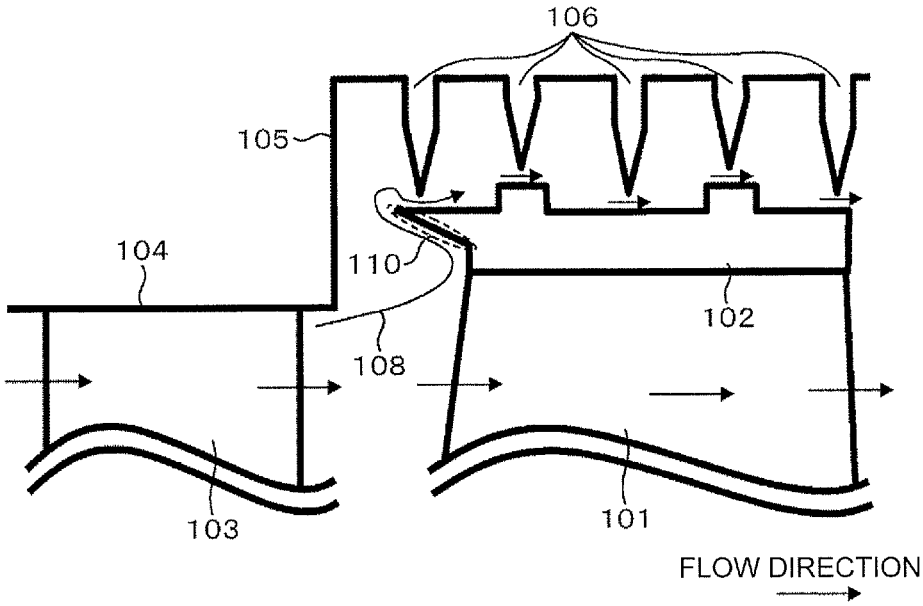
FIG. 7 is a cross-sectional view of a conventional turbine stage.

FIG. 7 illustrates a cross-sectional view of a conventional turbine stage. In FIG. 7, there are shown a moving blade 101, a shroud cover 102, a stator vane 103, an outer circumferential side stationary wall 104, a vertical surface 105 of the outer circumferential side stationary wall, and labyrinth seal fins 106. In a steam turbine, the stator vanes 103 and the moving blades 101 are paired to form a turbine stage. A plurality of the stator vanes 103 are provided in the circumferential direction and their outer circumferential ends are supported by the outer circumferential side stationary wall 104 which is a stationary body. In contrast, a plurality of the moving blades 101 are secured to a turbine rotor not shown in the circumferential direction. The shroud cover 102 is provided on the outer circumferential side distal ends of the moving blades 101 so as to connect together the plurality of moving blades provided in the circumferential direction. In general, the steam turbine has a plurality of the turbine stages in the axial direction of the turbine rotor, and an exhaust hood installed on the most downstream side thereof.

In the steam turbine as described above, operating steam is accelerated in the stator vane 103 formed as a convergent passage to increase kinetic energy. The moving blade 101 converts the kinetic energy into rotational energy to generate power. The operating steam is discharged to downstream stages while its pressure is progressively lowered.

A gap exists between the moving blade 101 and the outer circumferential side stationary wall 104 and a portion of the operating steam leaks from the gap. Such leakage flow 108 does not allow the moving blade 101 to generate power, leading to a loss. To minimize the leakage, the labyrinth seal fins 106 are provided on the outer circumferential side stationary wall 104 opposed to the shroud cover 102 on the outer circumference of the moving blades so as to extend vertically to the turbine shaft. The labyrinth seal fins 106, along with the outer circumferential side stationary wall 104, form labyrinth seals.

While passing through the passage narrowed by the labyrinth seal fins 106, the leakage flow 108 is accelerated and reduced in pressure. Next, the leakage flow 108 isobaric-expands and is decelerated in an expansion chamber. These are repeated to reduce the pressure. In this way, if the number of the labyrinth seal fins is increased, a pressure ratio between the front and rear of the labyrinth seal fins through which the leakage flow passes is reduced. Thus, an amount of the leakage is reduced.

The operating steam accelerated by the stator vanes 103 passes through a shroud cover inlet return portion 110 and enters the labyrinth seal portion while circling in the turbine-rotating direction (from the front toward the back vertically to the paper surface, which applies to FIGS. 1, 2, 3, 4, 5 and 6). Here, the shroud cover inlet return portion 110 means the inner circumferential surface of a steam inlet side end portion of the shroud cover 102.

Figure 8:
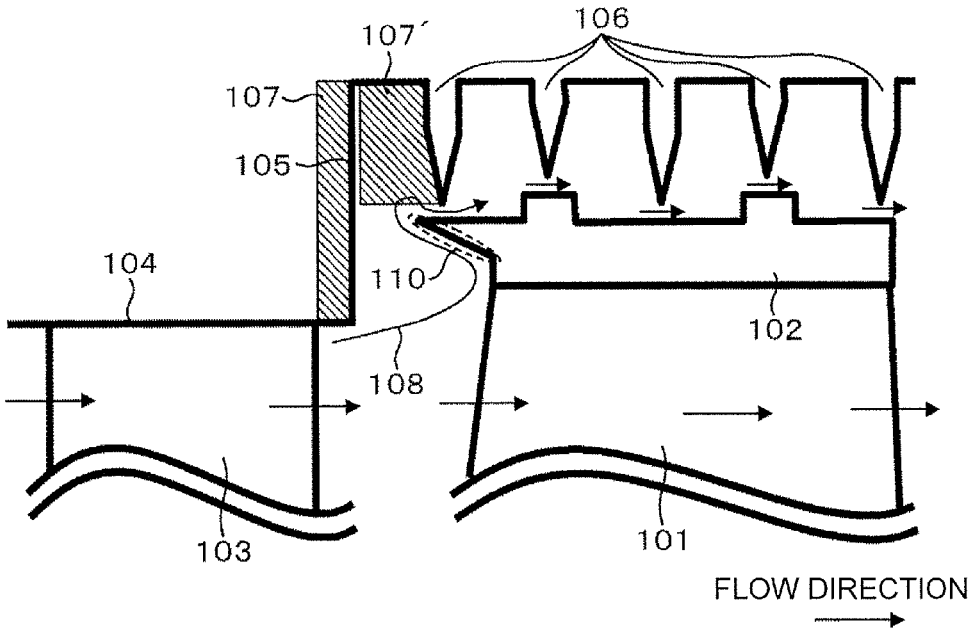
FIG. 8 is a cross-sectional view of the conventional turbine stage, illustrating a whirl preventing plate.

In order to reduce such whirl flow, a whirl preventing plate (107 or 107') has heretofore been installed on the vertical surface 105 of the outer circumferential side stationary wall on the upstream side of the labyrinth seals as illustrated in FIG. 8.

However, the whirl preventing plate (107 or 107') was found not to function satisfactorily in some cases depending on the trajectory of the leakage flow 108. For example, since a difference in thermal expansion between the rotor and the outer circumferential side stationary wall 104 is large, a distance between the shroud cover 102 and the outer circumferential side stationary wall vertical surface 105 may have to be increased. In such a case, the whirl flow 108 does not reach the whirl preventing plate 107 installed on the outer circumferential side stationary wall vertical surface 105. Thus, the whirl preventing plate 107 cannot exhibit the satisfactory function.

The present invention solves the problem as described above.

Embodiment 1

A first embodiment of the present invention will be described with reference to FIG. 1. FIG. 1 illustrates a structure of a turbine stage leakage portion as viewed from the radial direction (an upper view) and from the side (a lower view). In FIG. 1, there are shown a moving blade 1, a shroud cover 2, a stator vane 3, an outer circumferential side stationary wall 4, a vertical surface 5 of the outer circumferential side stationary wall, and labyrinth seal fins 6. In a steam turbine, the stator vanes 3 and the moving blades 1 are paired to form a turbine stage. A plurality of the stator vanes 3 are provided in the circumferential direction and their outer circumferential ends are supported by the outer circumferential side stationary wall 4 which is a stationary body. In contrast, a plurality of the moving blades 1 are secured to a turbine rotor not shown in the circumferential direction. The shroud cover 2 is provided on the outer circumferential side distal ends of the moving blades 1 so as to connect together the plurality of moving blades provided in the circumferential direction. The shroud cover 2 has a type in which the plurality of moving blades are assembled and secured by a single member, a type in which blade-integral covers are in close contact with each other at inter-blade pitch, and other types. The shroud cover 2 employed in the present embodiment may be of any one of these types.

In the present embodiment, whirl preventing plates 9 which are plate-like members are circumferentially installed at a given interval at a shroud cover inlet return portion 10. The shroud cover inlet return portion 10 means an internal circumferential surface of a steam inlet side end portion of the shroud cover 2.

The whirl preventing plates 9 are installed in the rotational field of the moving blades vertically to the leakage flow 8 (relative velocity w') of the return portion 10. A description is here given of a flow angle of the leakage flow 8. The upper view in FIG. 1 illustrates the relationship among absolute velocity v, relative velocity w, circumferential velocity u, a stator vane exit angle $\alpha$ and a relative exit flow angle $\beta_f$ at the exit of the stator vane, and relative velocity w' at the return portion. The steam accelerated by the stator vane flows out from the rear edge of the stator vane at absolute velocity v generally in the direction of stator vane exit angle $\alpha$. At the moving blade rotational field (relative field), the relative velocity w of the steam is obtained by the correction of the counter-rotational direction through the circumferential velocity u and the relative exit flow angle $\beta_f$ is defined on a circumferential basis. The direction of the leakage flow 8 (relative velocity w') passing through the return portion is based on a circumferential tangential line and has an angle of $\beta_f$ on the upstream side of the turbine. The whirl preventing plate 9 is installed vertically to the leakage flow at the return portion. In other words, the whirl preventing plate 9 is installed to tilt at an angle of $\beta_f$ in the counter-rotational direction of the rotor from the downstream side toward the upstream side in the operating steam flow direction on the basis of the turbine axial direction.

A moving blade inlet angle $\beta_{buc}$ is designed to be generally equal to the exit flow angle of $\beta_f$ of the relative velocity w, i.e., is designed at an incident angle of 0. Therefore, the installation angle of the whirl preventing plate 9 is approximately equal to the moving blade inlet angle.

The leakage flow 8 is blocked by the whirl preventing plate 9 and turned from the rotational direction to the counter-rotational direction to reduce an absolute velocity component in the rotational direction. Thus, an effect of reducing the whirl velocity of the leakage flow 8 can be provided.

Although a variation in incident angle is taken into account, the whirl preventing plate 9 can provide a whirl preventing function at a satisfactory level if it is installed in a range of approximately 90 °±15° with respect to the leakage flow 8.

The shroud cover inlet return portion 10 of the shroud cover 2 is a portion through which the leakage flow 8 inevitably passes regardless of the positional relationship with the outer circumferential side stationary wall 4. In the present embodiment, the whirl preventing plates 9 are installed at such a shroud cover inlet return portion 10; therefore, the effect of reducing the whirl velocity of the leakage flow 8 can be provided regardless of the relationship with the outer circumferential side stationary wall 4. In this way, since the whirl velocity of the leakage flow 8 is reduced, the occurrence potential of steam whirl can be reduced.

When the whirl component of the leakage flow 8 is reduced by the whirl preventing plates 9, whirl energy can be recovered as power. Therefore, turbine efficiency which is a ratio of shaft power to isentropic heat drop in front and rear of the stage can be improved.

Since the moving blade 1 is manufactured through machining by an NC machine tool, an increase in cost due to the provision of the whirl preventing plates 9 is insignificant.

Figure 3:
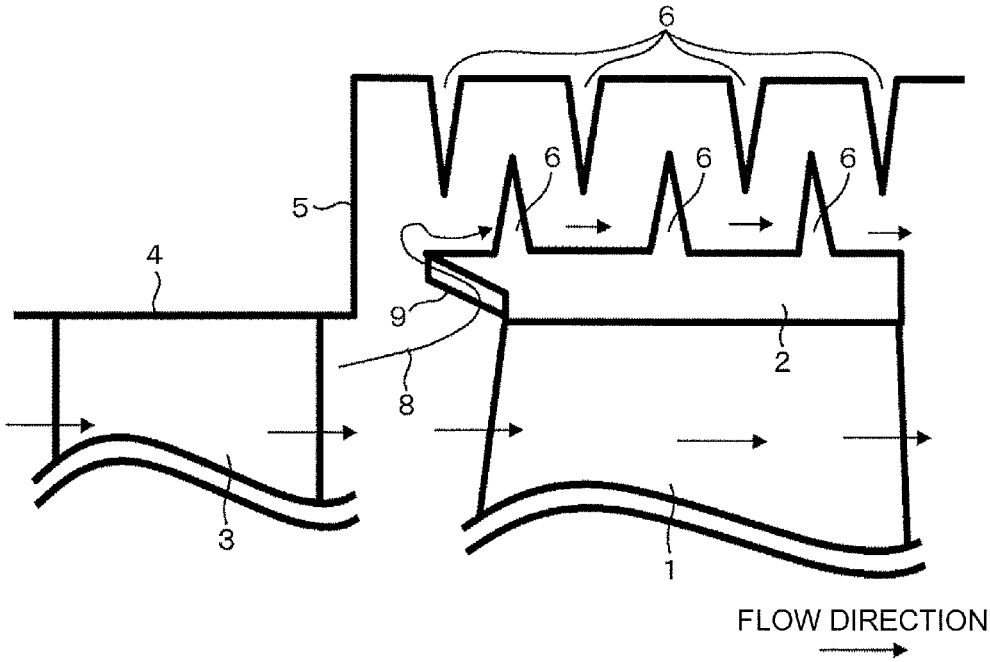
FIG. 3 is a cross-sectional view of the turbine stage according to the first embodiment of the present invention.

Incidentally, the labyrinth seal may have various forms, one of which is different in labyrinth pattern from that in FIG. 1 (FIG. 2), and another of which is provided with fins on the outer circumferential surface of the shroud cover 2 (FIG. 3). The application of any form produces the effects of the present invention.

Embodiment 2

Figure 4:
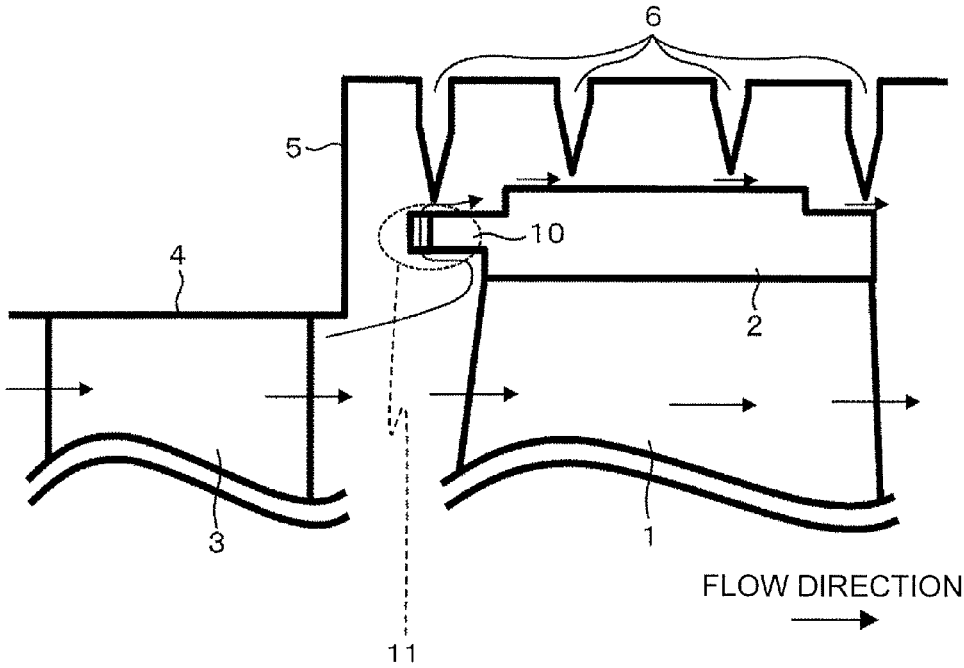
FIG. 4 is a cross-sectional view of a turbine stage according to a second embodiment of the present invention.
Figure 5:
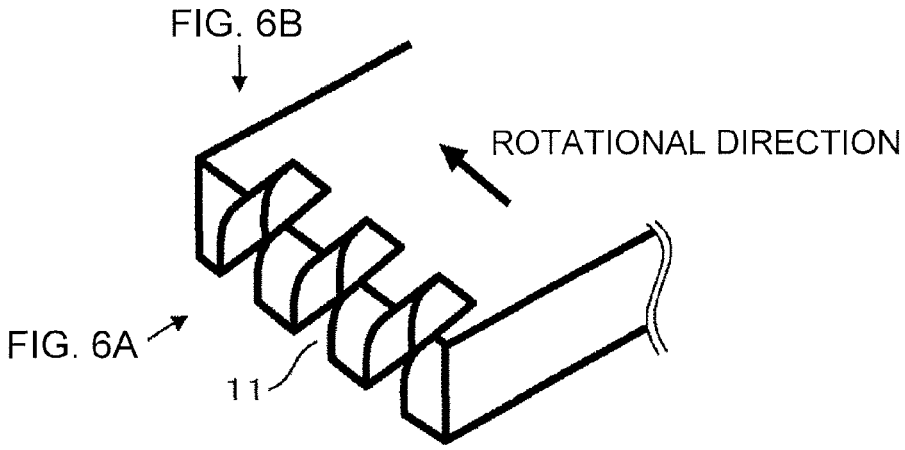
FIG. 5 is a perspective view of a structure of a whirl preventing groove according to a second embodiment of the present invention.

A description is next given of a second embodiment of the present invention. FIG. 4 illustrates a structure of a turbine stage leakage portion as viewed from the side and FIG. 5 illustrates a structure of a whirl preventing groove 11 at a steam inlet side end portion of a shroud cover 2. Incidentally, constituent elements similar to those of the first embodiment are denoted with like reference numerals and their explanation is omitted.

The present embodiment differs from the first embodiment in that whirl preventing grooves 11 are characteristically provided at the steam inlet side end portion of the shroud cover 2 in place of the whirl preventing plate 9.

Figure 6A:
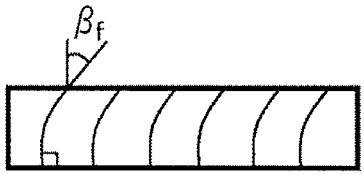
FIG. 6A is a axial view of the whirl preventing groove illustrated in FIG. 5.

The whirl preventing grooves 11 radially passes through from the shroud cover inlet return portion 10 to the shroud outer circumferential surface. The whirl preventing grooves 11 as viewed from the axially upstream side are shown in FIG. 6A. The inner circumferential surface of the shroud cover return portion is generally vertical to the whirl preventing grooves 11. On the outer circumferential side of the shroud cover, the whirl preventing grooves 11 are tilted at an angle $\beta_f$ toward the direction opposite the rotational direction with respect to the radial direction. In other words, the whirl preventing grooves 11 are tilted at almost the same angle as the moving blade inlet angle.

Figure 6B:
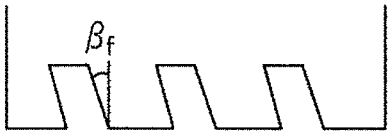
FIG. 6B is a radial view of the whirl preventing groove illustrated in FIG. 5.

The whirl preventing grooves 11 as viewed from the radial direction are shown in FIG. 6B. The whirl preventing groove 11 has a depth tilted at an angle $\beta_f$ in the rotational direction from the upstream side toward the downstream side in the operating steam flow direction, with respect to the turbine-axial direction, i.e., at an angle generally equal to the moving blade inlet angle.

The leakage flow 8 passing through the shroud cover inlet return portion 10 is introduced into the whirl preventing grooves 11. The leakage flow is blocked by the whirl preventing grooves 11 and turned from the rotational direction to the counter-rotational direction to apply kinetic momentum to the whirl preventing grooves 11, and thereby reducing its absolute velocity component in the rotational direction.

The shroud cover inlet return portion 10 of the shroud cover 2 is a portion through which the leakage flow 8 inevitably passes regardless of the positional relationship with the outer circumferential side stationary wall 4. In the present embodiment, the whirl preventing grooves 11 are installed at such a shroud cover inlet return portion 10; therefore, the effect of reducing the whirl velocity of the leakage flow 8 can be provided regardless of the relationship with the outer circumferential side stationary wall 4. In this way, since the whirl velocity of the leakage flow 8 is reduced, the occurrence potential of steam whirl can be reduced.

When the whirl component of the leakage flow 8 is reduced by the whirl preventing grooves 11, whirl energy can be recovered as power. Therefore, turbine efficiency which is a ratio of shaft power to isentropic heat drop in front and rear of the stage can be improved. Since the moving blade 1 is manufactured through machining by an NC machine tool, an increase in cost due to the provision of the whirl preventing grooves 11 is insignificant. Thus, the present embodiment can produce the same effect as that of the first embodiment.

Incidentally, the first and second embodiments may be each combined with a whirl preventing plate 7 or 7' as shown in FIG. 8. Such a combination improves whirl preventing effect.

What is claimed is:

1. A rotor oscillation preventing structure for a steam turbine, comprising:

a stator vane;

a moving blade;

a shroud cover installed on an outer circumferential side distal end of the moving blade;

a plurality of seal fins installed, at any interval in the axial direction of a rotor, on a wall surface of a stationary body located on an outer circumferential side of the shroud cover; and a whirl preventing structure provided at a shroud cover inlet return portion of the shroud cover so as to block whirl flow of leakage flow on an upstream side in an operating steam flow direction of the seal fins, and to reduce an absolute velocity component of the leakage flow in a rotational direction of the rotor, wherein the whirl preventing structure has a plurality of plate-like members installed, at a given interval in a circumferential direction of the turbine, at the shroud cover inlet return portion of the shroud cover, and at least one of the plate-like members is installed to tilt in a counter-rotational direction of the rotor from a downstream side toward an upstream side in the operating steam flow direction, with respect to a turbine-axial direction.

2. The rotor oscillation preventing structure according to claim 1, wherein the plate-like member is installed to tilt at the same angle as a moving blade inlet angle of the moving blade in the counter-rotational direction of the rotor from the downstream side toward the upstream side in the operating steam flow direction, with respect to the turbine-axial direction.

3. The rotor oscillation preventing structure according to claim 1, wherein the plate-like member is installed to have an angle of 75° to 105° in a rotational field of the moving blade, with respect to the leakage flow.

4. A rotor oscillation preventing structure for a steam turbine, comprising:

a stator vane;

a moving blade;

a shroud cover installed on an outer circumferential side distal end of the moving blade;

a plurality of seal fins installed, at any interval in the axial direction of a rotor, on a wall surface of a stationary body located on an outer circumferential side of the shroud cover; and a whirl preventing structure provided at a shroud cover inlet return portion of the shroud cover so as to block whirl flow of leakage flow on an upstream side in an operating steam flow direction of the seal fins, and to reduce an absolute velocity component of the leakage flow in a rotational direction of the rotor, wherein the whirl preventing structure includes a groove provided at a steam inlet side end portion of the shroud cover and passing through from the shroud inlet return portion toward a shroud outer circumferential surface, an inner circumferential side of the groove being vertical to an inner circumferential surface of the shroud cover return portion, an outer circumferential side of the groove being tilted toward a side opposite the rotational direction of the rotor with respect to the radial direction, and a depth of the groove being tilted on the rotor rotational-directional side from an upstream side to a downstream side in the operating steam flow direction, with respect to a turbine-axial direction.

5. The rotor oscillation preventing structure according to claim 4, wherein the groove has the outer circumferential side tilted toward the direction opposite the rotational direction of the rotor with respect to the radial direction at the same angle as a moving blade inlet angle of the moving blade, the groove being provided to tilt, with respect to the turbine-axial direction, in the rotational direction of the rotor from the upstream side toward the downstream side in the operating steam flow direction at the same angle as the moving blade inlet angle of the moving blade.

6. A steam turbine comprising:

a turbine stage including a plurality of stator vanes installed circumferentially and supported by a stationary body, and a plurality of moving blades installed in a circumferential direction of a turbine rotor, the moving blades having at outer circumferential side distal ends a shroud cover connecting together the moving blades, wherein the shroud cover has a whirl preventing structure for blocking whirl flow of leakage flow to reduce an absolute velocity component of the leakage flow in a rotational direction of the rotor, the whirl preventing structure being provided at an inner circumferential surface of an operating steam inlet side end portion of the shroud cover, the whirl preventing structure includes a plurality of plate-like members, at any interval in a turbine circumferential direction, on the inner circumferential surface of the operating steam inlet side end portion of the shroud cover, and at least one of the plate-like members is installed to tilt in a counter-rotational direction of the rotor from a downstream side toward an upstream side in an operating steam flow direction, with respect to a turbine-axial direction.

7. The steam turbine according to claim 6, wherein the plate-like member is installed to tilt at the same angle as a moving blade inlet angle of the moving blade in the counter-rotational direction of the rotor from the downstream side toward the upstream side in the operating steam flow direction, with respect to the turbine-axial direction.

8. The steam turbine according to claim 6, wherein the plate-like member is installed to have an angle of 75° to 105° in a rotational field of the moving blade, with respect to the leakage flow.

9. A steam turbine comprising:

a turbine stage including a plurality of stator vanes installed circumferentially and supported by a stationary body, and a plurality of moving blades installed in a circumferential direction of a turbine rotor, the moving blades having at outer circumferential side distal ends a shroud cover connecting together the moving blades, wherein the shroud cover has a whirl preventing structure for blocking whirl flow of leakage flow to reduce an absolute velocity component of the leakage flow in a rotational direction of the rotor, the whirl preventing structure being provided at an inner circumferential surface of an operating steam inlet side end portion of the shroud cover, the whirl preventing structure includes a groove provided at a steam inlet side end portion of the shroud cover and passing through from the shroud inlet return portion to a shroud outer circumferential surface, an inner circumferential side of the groove being vertical to an inner circumferential surface of the shroud cover, an outer circumferential side of the groove being tilted toward a side opposite the rotational direction of the rotor with respect to the radial direction, and a depth of the groove being tilted on the rotor rotational-directional side from an upstream side to a downstream side in the operating steam flow direction, with respect to a turbine-axial direction.

10. The steam turbine according to claim 9, wherein the groove has the outer circumferential side tilted toward the direction opposite the rotational direction of the rotor with respect to the radial direction at the same angle as a moving blade inlet angle of the moving blade, the groove being provided to tilt, with respect to the turbine-axial direction, in the rotational direction of the rotor from the upstream side toward the downstream side in the operating steam flow direction at the same angle as the moving blade inlet angle of the moving blade.

* * * * *